United States Patent [19]

Hodek

[11] Patent Number: 4,464,245

[45] Date of Patent: Aug. 7, 1984

[54] METHOD OF INCREASING THE OIL YIELD FROM HYDROGENATION OF COAL

[75] Inventor: Werner Hodek, Essen, Fed. Rep. of Germany

[73] Assignee: Bergwerksverband GmbH, Essen, Fed. Rep. of Germany

[21] Appl. No.: 309,396

[22] Filed: Oct. 7, 1981

[30] Foreign Application Priority Data

Oct. 15, 1980 [DE] Fed. Rep. of Germany ..... 3038842

[51] Int. Cl.[3] ..... C10G 1/06

[52] U.S. Cl. ..... 208/10; 208/8 LE

[58] Field of Search ..... 208/10, 8 LE

[56] References Cited

U.S. PATENT DOCUMENTS

| | | | |
|---|---|---|---|
| 3,488,279 | 1/1970 | Schulman | 208/10 |
| 3,583,900 | 6/1971 | Gatsis | 208/8 LE |
| 3,640,816 | 2/1972 | Bull et al. | 208/10 |
| 4,089,772 | 5/1978 | Gorbaty et al. | 208/8 LE |
| 4,105,535 | 8/1978 | Peters | 208/8 LE |
| 4,148,709 | 4/1979 | Sze | 208/10 |
| 4,189,371 | 2/1980 | Maa et al. | 208/10 |
| 4,251,346 | 2/1981 | Dry et al. | 208/10 |
| 4,318,797 | 3/1982 | Jager et al. | 208/8 LE |

*Primary Examiner*—Delbert E. Gantz
*Assistant Examiner*—Cynthia A. Prezlock
*Attorney, Agent, or Firm*—Michael J. Striker

[57] ABSTRACT

The overall yield from hydrogenation of coal is increased by following the method of the present invention according to which additional amounts of oil are released from the separated residue obtained in a vacuum distillation operation following the initial coal hydrogenation, in that a light oil fraction obtained during the initial coal hydrogenation and having a boiling point in the range between 35° and 200° C. is added to the residue to act as a solvent therefor, whereupon the solution is hydrogenated at a temperature in the range between 350° and 450° C. under a hydrogen pressure of 300 to 400 bar for 0.5 to 2 hours. The solvent advantageously includes alkanes, cycloalkanes, aromatics, phenols or mixtures thereof having their boiling points within the above range. A catalyst selected from the series of transition metals may be added to further increase the oil yield from the hydrogenation of the residue.

6 Claims, No Drawings

METHOD OF INCREASING THE OIL YIELD FROM HYDROGENATION OF COAL

BACKGROUND OF THE INVENTION

The present invention relates to the hydrogenation of coal in general, and more particularly to a method of increasing the oil yield from such coal hydrogenation.

Coal oil is usually obtained from coal by subjecting finely comminuted coal particles to a hydrogenation operation at an elevated pressure and at a high temperature by contacting the coal particles with molecular hydrogen or with hydrogen-releasing solvents. During this operation, the coal which, among others, contains high-molecular aromatic compounds, is decomposed, at least to the predominant degree, into low-molecular products. These low-molecular products include gaseous hydrocarbons, distillable oils, as well as soluble and meltable, but not distillable substances which can be found in the so-called hydrogenation residue.

While the liquid fractions or oils can be used in motor vehicle fuels or as raw materials in the chemical industry, the gaseous hydrocarbons can be used as gaseous fuels or also as starting materials in the chemical industry. On the other hand, the hydrogenation residue is either returned into the hydrogenation operation, which may result in difficulties in the processing, or it may be subjected to a low-temperature carbonization which, however, results in a considerable burden on the environment.

The hydrogenation residue consists of non-reacted coal, mineral components of the coal, asphalts, as well as of minute amounts of heavy oils. According to the current concepts in the area of large-scale coal hydrogenation, the components of the residue should be gasified in order to produce in this manner a part of the hydrogen needed for the coal hydrogenation.

It is known that asphalt-containing hydrogenation products can be decomposed into distillable oils in a stationary bed reaction vessel on catalysts selected from the series of transition metals, under hydrogen pressure and at high temperatures, at least to a considerable degree. However, this process, which is known, for instance, from "Chemieprodukte aus Kohle" by Falbe, published by Verlag Thieme in Stuttgart in 1977, page 98, requires a preceding segregation of the insoluble mineral and coal components by filtration. This is a very cumbersome and difficult operation which is too expensive to be used for the required high throughputs. In addition thereto, the catalysts become inactive within a short period of time due to the deposition of coke particles.

It is further known that asphalt-containing hydrogenation products can be decomposed into distillable oils in high boiling point aromatic oils and with the addition of catalysts at temperatures between 450° and 500° C., as disclosed in the above publication on page 84. The throughput, however, is only sufficient when highly active catalysts are being used, or when the operation is conducted at very high pressures of up to 700 bar.

In these conventional methods, the catalysts can not be reclaimed. Additionally, the solvent is partially decomposed into gaseous hydrocarbons, so that both of the conventional methods are performed under very uneconomical conditions.

SUMMARY OF THE INVENTION

It is a general object of the present invention to avoid the disadvantages of the prior art.

More particularly, it is an object of the invention to develop a method of coal hydrogenation which renders it possible to increase the yield of oil in a very economical manner.

Still another object of the invention is to provide an economical method of obtaining additional oil from the residue of a preceding coal hydrogenation operation.

In pursuance of these objects and others which will become apparent hereafter, one feature of the present invention resides in a method of increasing the overall oil yield from hydrogenation of coal by releasing additional oil amounts from a separated residue obtained in a vacuum distillation operation following initial coal hydrogenation and containing components boiling at very high temperatures, if at all, the method comprising, briefly stated, the steps of adding to the residue a light oil fraction obtained during the initial coal hydrogenation and having a boiling range of between 35° and 200° C. for the light oil fraction to act as a solvent for the residue; and hydrogenating the solution at a temperature in the range between 350° and 450° C. under a hydrogen pressure of 300 to 400 bar for 0.5 to 2 hours.

According to a further aspect of the present invention, the adding step includes adding to the residue a solvent selected from the group consisting of alkanes, cyclolakanes, one-ring aromatics, phenols and mixtures thereof with a boiling point in the range between 35° and 200° C. In this context, it is especially advantageous to use, for instance, hexane, cyclohexane, toluol or phenol, or mixtures thereof, for the solvent. A further increase in the oil yield is obtained when, in accordance with a further concept of the present invention, the distillation residue is hydrogenated in the presence of a catalyst selected from the group of transition metals. Particularly advantageous catalysts in this respect are iron oxide, zinc chloride or cobalt-molybdenum compounds.

DETAILED DESCRIPTION OF THE PREFERRED EMBODIMENTS

During the catalytical hydrogenation of coal with molecular hydrogen, there is obtained approximately 20% of hydrocarbon gases, 50% of distillable oils, 20% of asphalts and 10% of insoluble remaining coal. When the hydrogenation of coal is performed in hydrogen-releasing solvents, the asphalt content can be, depending on the reaction conditions, as high as 50% or even more. Inasmuch as the distillable oils are the most valuable products of the coal hydrogenation, it is desired to achieve as high a yield of oil as possible.

The vacuum distillation residue which is needed for the performance of the hydrogenation in accordance with the present invention is obtained, for instance, in the following manner:

A suspension of 100 parts by weight of finely comminuted coal and 200 parts by weight of oil mixture including 40% of medium oil having a boiling point in the range of 200° to 325° C. and 60% of heavy oil having a boiling point in the range over 325° C. is reacted in the presence of 2 parts by weight of hydrogenation catalyst in a reaction vessel under hydrogen pressure of 300 bar and at a temperature of 465° C. for two hours.

Thereafter, the reaction products which boil only at high temperatures, if at all, are separated in a hot separator from the hydrogenation product mixture. Such separated reaction products include heavy oils, asphalts, mineral materials and remaining coal. On the other hand, the more easily boiling and the gaseous products are captured in following separators.

The product separated in the hot separator is then distilled in vacuum until there is obtained a residue, while the products released during the vacuum distillation are withdrawn as oils. The remaining distillation residue is then processed in accordance with the present invention. A particular advantage of the present invention resides in an increase of the overall yield from the coal hydrogenation after the performance of the method of the present invention. Practically no loss of the used solvent is encountered, inasmuch as the solvent can be easily separated from the hydrogenation products and can then be recirculated.

EXAMPLE 1

A distillation residue of a hot separator product of coal hydrogenation has the following composition:

Oil with boiling point below 300° C.: 0 weight %
Pyridine solubles (asphalts etc): 60.8 weight %
Insolubles (coal rest, minerals): 39.2 weight %

30 parts by weight of this distillation residue are mixed in a rolling autoclave with 150 parts by weight of light oil obtained during the coal hydrogenation and then the mixture is hydrogenated at 450° C. under a hydrogen pressure of 300 bar for one-half hour. After the cooling, the reaction product is removed from the autoclave and is distilled upto a head temperature of 300° C. The last oil remainders are removed by extraction with hexane. The remaining product is extracted with pyridine, in order to remove the insoluble components. The hydrogenation product has the following composition:

Oil with boiling point below 300° C.: 42 weight %
Pyridine solubles: 20 weight %
Insolubles: 38 weight %.

The oil which is used as the solvent has the following composition:

Boiling range: 35°–200° C.
aliphates: 34 weight %
cycloaliphates: 10 weight %
aromatics: 36 weight %
olefins: 6 weight %
phenols: 14 weight %.

EXAMPLE 2

30 parts by weight of the distillation residue are mixed with 15 parts by weight of light oil (both having the same compositions as above). Then, the mixture is hydrogenated at 350° C. under a hydrogen pressure of 400 bar for 2 hours. The hydrogenation and the following handling are performed in the same manner as described in Example 1. The hydrogenation product has the following composition:

Oil with boiling point below 300° C.: 44 weight %
Pyridine solubles: 19 weight %
Insolubles: 37 weight %

COMPARISON EXAMPLE

When, for comparison, the same hydrogenation as above is performed, but using the oil mixture used in the coal hydrogenation instead of the light oil, the hydrogenation product has the following composition:

Oil with boiling point below 300° C.: 15 weight %
Pyridine solubles: 48 weight %
Insolubles: 27 weight %

The comparison example shows that a substantially higher oil yield is obtained when light oil is used as the solvent for the distillation residue, as compared with the result obtained when using the oil mixture as the solvent.

EXAMPLE 3

The hot separator product described above in Example 1 has the insoluble components (remaining coal, minerals) removed therefrom by filtration. The filtrate is distilled in vacuum. In this manner, there is obtained a solid-free distillation residue which does not contain any oil components with a boiling point below 300° C.

Then, 30 parts by weight of the solid-free distillation residue are mixed with 15 parts by weight of light oil and the mixture is hydrogenated under a hydrogen pressure of 350 bar at 450° C. for half an hour. The yield of oil with a boiling point below 300° C. is 69.3 weight %.

EXAMPLE 4

30 parts by weight of the solid-free distillation residue described above in connection with Example 3 are mixed with 150 parts by weight of light oil and with 1 part by weight of $Fe_2O_3$. The mixture is then hydrogenated under hydrogen pressure of 300 bar at 400° C. for 1 hour. The yield of oil with a boiling point below 300° C. is 81.1 weight %.

COMPARISON EXAMPLE 30 parts by weight of the distillation residue described in Example 3 are mixed with 100 parts by weight of the oil mixture and with 1 part by weight of $Fe_2O_3$. Then, the mixture is hydrogenated under hydrogen pressure of 300 bar at 450° C. for 2 hours. The yield of oil with a boiling point below 300° C. is 65.3 weight %.

Examples 3 and 4 show that the hydrogenation in light oil without a catalyst brings about approximately the same yield of oil as the hydrogenation in the oil mixture with the catalyst, as described in the present comparison example. On the other hand, during hydrogenation in light oil, a further increase in the oil yield can be accomplished by the addition of a hydrogenation catalyst.

EXAMPLE 5

In order to establish the effect of the individual components contained in the light oil, the following tests have been performed using the distillation residue described in connection with Example 3:

| Solvent | Solvent/ residue | p (bar) | T (°C.) | Time (h) | Oil yield (weight %) |
|---|---|---|---|---|---|
| n-hexane | 5:1 | 300 | 450 | 2 | 68.4 |
| cyclohexane | 1:1 | 400 | 350 | 1 | 60.2 |
| toluol | 2:1 | 300 | 400 | ½ | 65.8 |
| phenol | 5:1 | 300 | 400 | 1 | 64.9 |

While the invention has been described as used for increasing the oil yield from distillation residues of coal hydrogenation products, it is not intended to be limited to the details dscribed since various modifications may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. A method of increasing the overall oil yield from hydrogenation of coal by releasing additional oil amounts from a separated asphalts-containing hydrogenation residue obtained in a hot separation operation following initial coal hydrogenation and consisting of components boiling at temperatures above 300° C., if at all, comprising the steps of adding to the residue only a light oil fraction obtained during the initial coal hydrogenation and having a boiling range of between 35° and 200° C. for the light oil fraction to act as a solvent for the residue; and hydrogenating the solution at a temperature in the range between 350° and 450° C. under a hydrogen pressure of 300 to 400 bar for 0.5 to 2 hours.

2. The method as defined in claim 1, wherein said adding step includes adding to the residue a solvent selected from the group consisting of alkanes, cycloalkanes, one-ring aromatics, phenols and mixtures thereof with a boiling point in the range between 35° and 200° C.

3. The method as defined in claim 1, wherein said adding step includes adding to the residue a solvent selected from the group consisting of n-hexane, cyclohexane, toluol, phenol and mixtures thereof.

4. The method as defined in claim 1; and further comprising the step of performing said hydrogenating step in the presence of a catalyst selected from the group consisting of transition metals.

5. The method as defined in claim 1; and further comprising the step of performing said hydrogenating step in the presence of a catalyst selected from the group consisting of iron oxide, zinc chloride and cobalt-molybdenum compounds and mixtures thereof.

6. A method of releasing additional oil amounts from a separated residue of an initial coal hydrogenation that substantially consists of components boiling at very high temperatures, if at all, comprising the steps of adding to the residue a solvent consisting only of light oil having a boiling range of between 35° and 200° C. to form a solution; and hydrogenating the solution at a temperature in the range between 350° and 450° C. under a hydrogen pressure of 300 to 400 bar for 0.5 to 2 hours.

* * * * *